United States Patent [19]

Matsumoto

[11] Patent Number: 4,916,770

[45] Date of Patent: Apr. 17, 1990

[54] PORTABLE ELECTRIC SHOE SHINER

[75] Inventor: Tamotsu Matsumoto, Narashino, Japan

[73] Assignees: Midori Co., Ltd., Tokyo; Form Design Incorporation, Chiba, both of Japan

[21] Appl. No.: 245,762

[22] Filed: Sep. 16, 1988

[30] Foreign Application Priority Data

Feb. 17, 1988 [JP] Japan ..... 63-19389

[51] Int. Cl.[4] ..... A47L 23/06

[52] U.S. Cl. ..... 15/28; 15/97 R

[58] Field of Search ..... 15/28, 29, 97 R, 97 A

[56] References Cited

U.S. PATENT DOCUMENTS 2,728,928 1/1956 Beeren ..... 15/29
4,016,617 4/1977 Cardus ..... 15/29
4,312,091 1/1982 Cardus ..... 15/29
4,476,602 10/1984 Hurn et al. ..... 15/28

FOREIGN PATENT DOCUMENTS 2025759 1/1980 United Kingdom ..... 15/28

*Primary Examiner*—Edward L. Roberts
*Attorney, Agent, or Firm*—Darby & Darby

[57] ABSTRACT

A portable shoe shiner that includes a shining member for shining shoes; an electric motor for rotating the shining member; and a housing for including the shining member and the electric motor therein. The portable shoe shiner is further equipped with a sliding element for slidably supporting the shining member and the electric motor between a first position and a second position relative to the housing, the shining member extending from the housing at the first position and being retracted into the housing at the second position.

5 Claims, 6 Drawing Sheets

PORTABLE ELECTRIC SHOE SHINER

BACKGROUND OF THE INVENTION

The present invention relates to a portable electric shoe shiner in which a shoe brush or the like, which is mounted so that it can be moved in and out, is rotated by the turning force of a built-in motor so that a shoe is easily shined.

A conventional electric shoe shiner of such kind was proposed as disclosed in the Japanese Utility Model Laid-Open No. 56-78760. In the shoe shiner, a shaft, which is rotated by an electric motor mounted in a case extending to a grip, slightly projects out of the opening of the case. A groove and a notch are provided on the outer peripheral surface of the slightly projecting portion of the shaft. A brush formed by securing hair to a base fitted with a spring in an insertion hole provided in the center of the base, and a finish-shining member formed by securing wool to a base fitted with a spring in an insertion hole provided in the center of the base are separately prepared so that the brush and the finish-shining member can be alternately and removably mounted on the shaft. However, since the brush or the finish-shining member projects out of the case even if the shoe shiner is not in use, the shoe shiner has a drawback that the shoe shiner cannot be made portable unless an appropriate cap is attached around the projecting brush or finish-shining member.

SUMMARY OF THE INVENTION

Thus, the present invention was made so as to obviate the above-mentioned drawback and provide a portable electric shoe shiner small in size and weight and good in portability.

In the portable electric shoe shiner of the present invention, a shining member such as a shoe brush or a finishing wool buff can be rotated by the turning force of a motor built in the shoe shiner. A battery housing is formed in a main case so as to store a plurality of batteries as an electric source. An opening is provided in the bottom of the main case. A sliding cover for optionally opening or closing the opening of the main case is slidably attached to the bottom of the main case. A drive mechanism including the motor and a speed reduction gear train, which is capable of rotating a drive gear means, is provided in the main case. A rotary drive shaft is slidably fitted in a shaft hole of the drive gear means so that the turning force of the drive gear means can be transmitted to the rotary drive shaft. A shining member attaching device is secured to the rotary drive shaft. The shining member is removably mounted on the shining member attaching device. Means for operating the attaching device is coupled to the shining member attaching device. A sliding switch is coupled to the means for operating the attaching device. The shining member can be moved into or out of the opening of the main case by an operation of the sliding switch. The drive mechanism acts in conjunction with the operation of the sliding switch so as to drive the rotary drive shaft and drive gear means and then rotate the shoe shining member by the turning force of the drive gear means once the shoe shining member has moved out of the opening of the main case.

According to the present invention, the following effects are obtained;

(1) At the time of the portable electric shoe shiner being not in use, the shoe brush or the like is housed in the main case and the opening thereof is closed with the sliding cover to prevent the shoe shining member such as a shoe brush or a finish-shining wool buff from contaminating other things. Therefore, the portability of the shoe shiner is good. And further, the portable electric shoe shine, by being able to be constructed small in size and weight and simple in construction, the shoe shiner is less likely to develop trouble and has high durability and low cost.

(2) At the time of the shining member being moved out of the opening of the main case, the engagement of the drive gear means and the rotary drive shaft is surely maintained because the turning force of the drive gear means is surely and smoothly transmitted to the rotary drive shaft.

(3) Since the shining member is removably mounted on the shining attaching device, a number of different kinds of shining members can be interchangeably and easily mounted on the shining member attaching device.

(4) Since the shining member is automatically rotated by the turning force of the drive gear means once the shining member has moved out of the opening of the main case, the operability of the portable electric shoe shiner is excellent.

PREFERRED EMBODIMENTS OF THE PRESENT INVENTION

Figure 1:
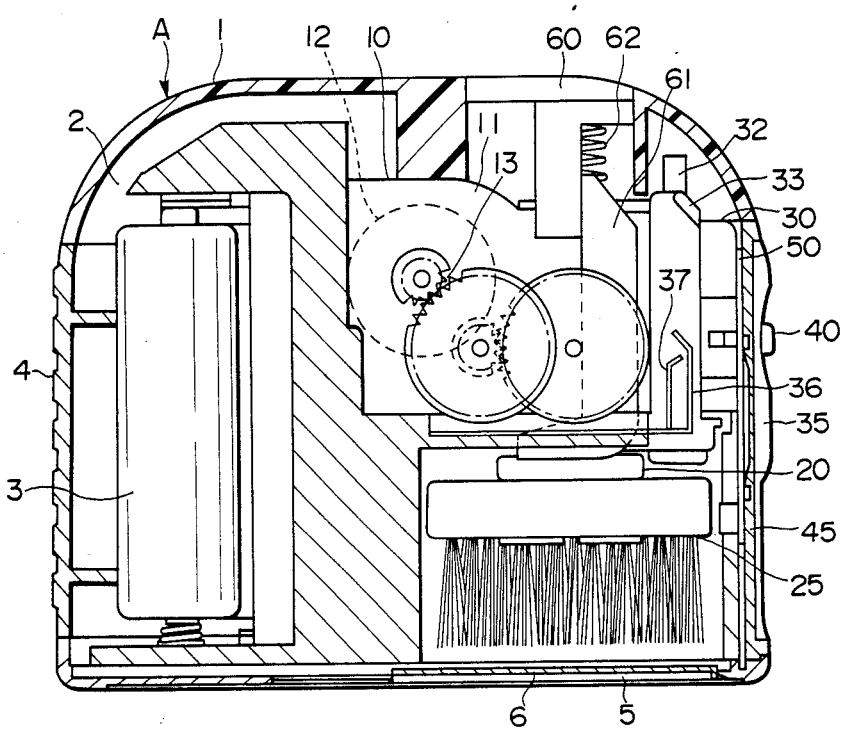
FIG. 1 shows a partially cutaway front view of a portable electric shoe shiner according to an embodiment of the present invention illustrating a speed reduction gear train.
Figure 2:
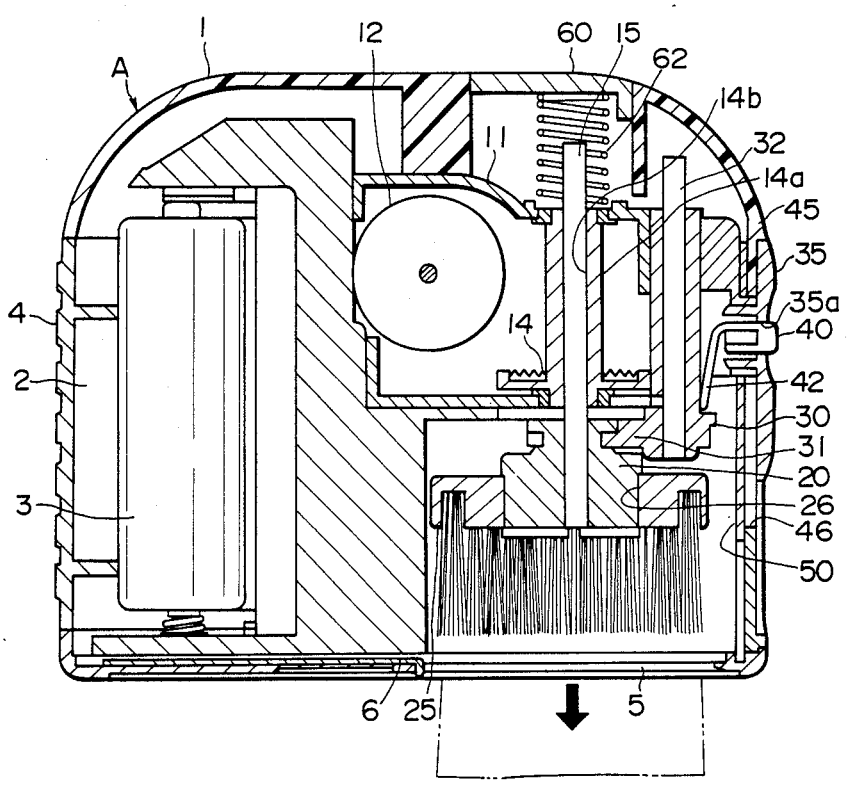
FIG. 2 shows another partially cutaway cross sectional front view of the portable electric shoe shiner illustrating an operation thereof.
Figure 3:
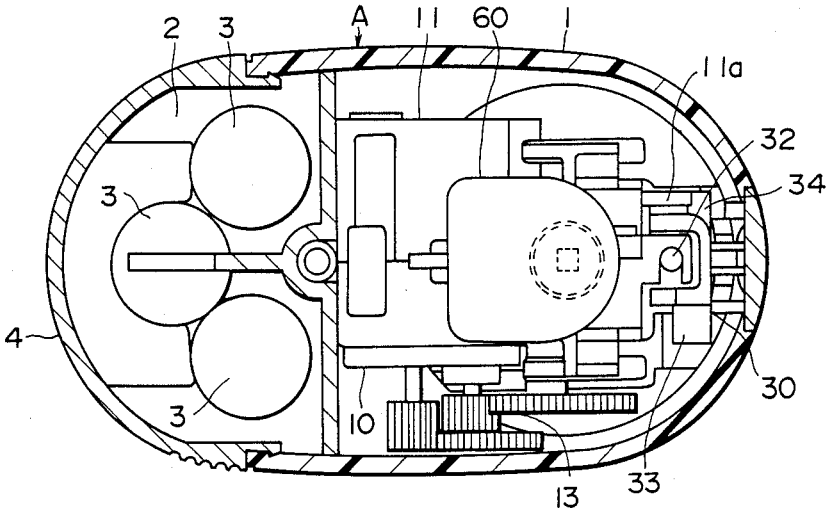
FIG. 3 shows a partially cutaway plan view of the portable electric shoe shiner illustrating a speed reduction gear train.
Figure 4:
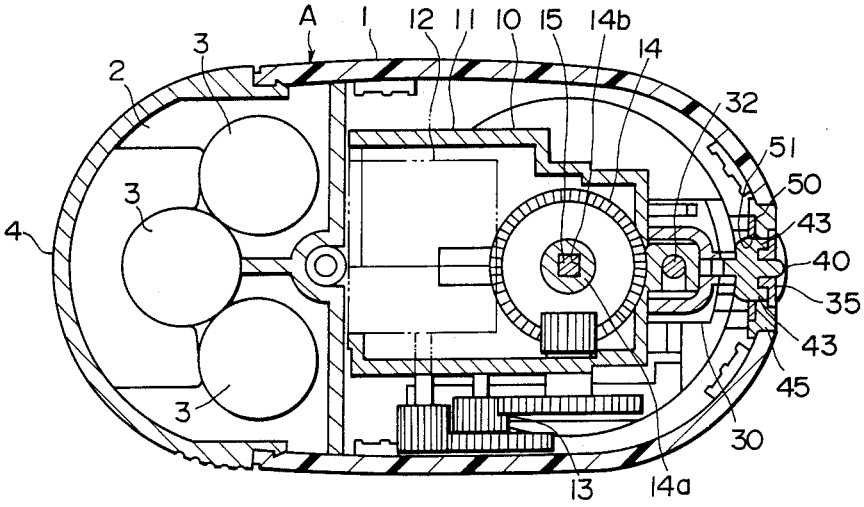
FIG. 4 shows another cutaway plan view of the portable electric shoe shiner illustrating an operation thereof.
Figure 5:
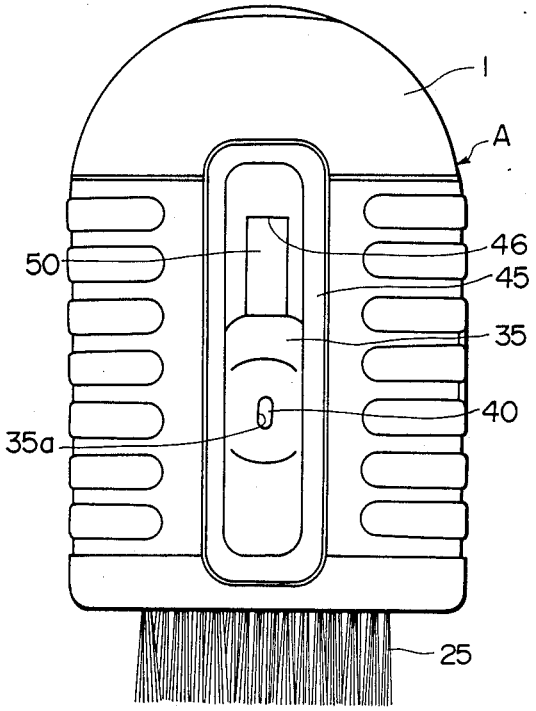
FIG. 5 shows a side view of the portable electric shoe shiner when the shoe brush is moved out of the case and is rotating.
Figure 6:
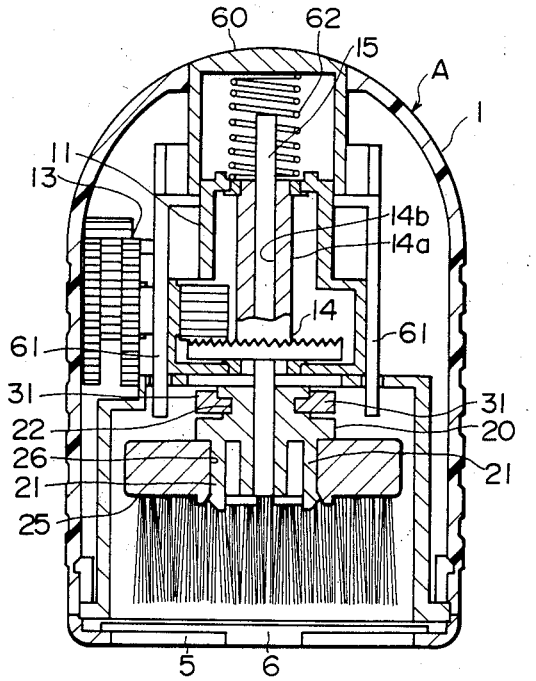
FIG. 6 shows a cutaway front view of the portable electric shoe shiner illustrating an operation thereof.
Figure 7:
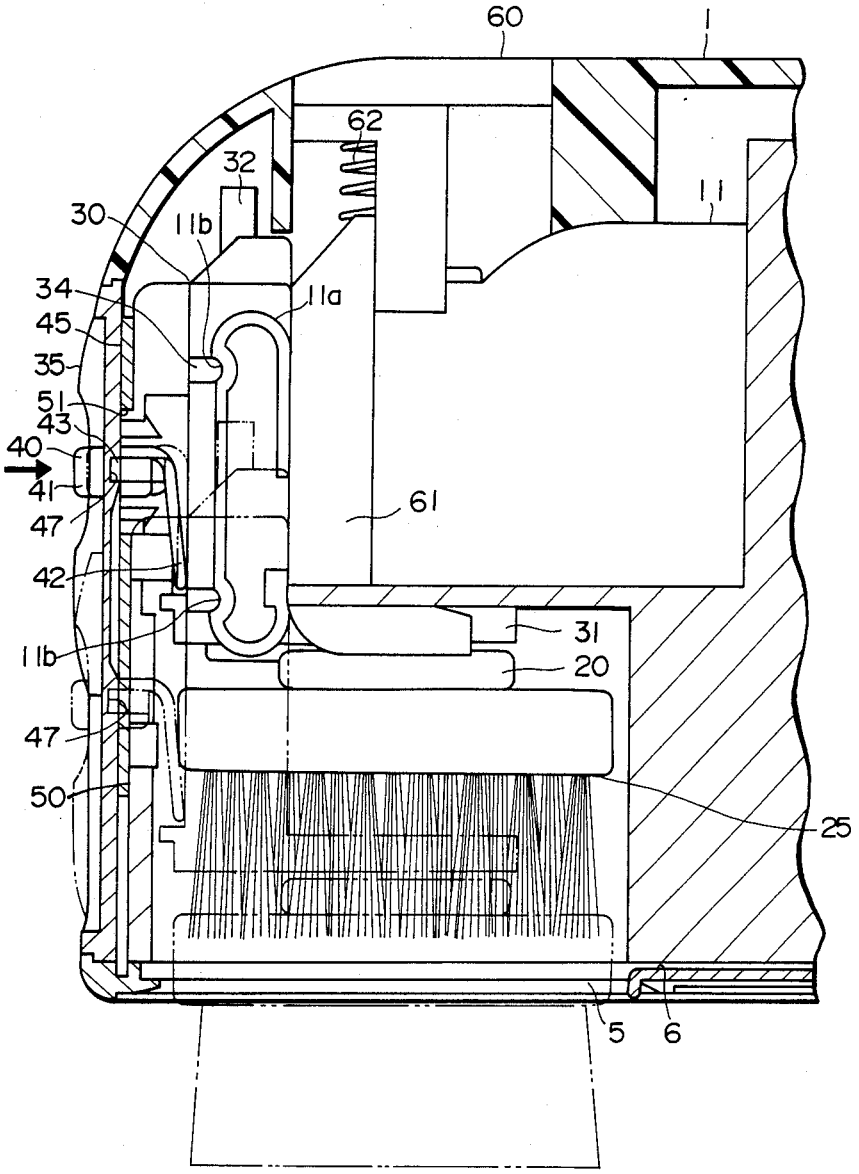
FIG. 7 shows a detailed portion cross sectional and phantom view of the portable electric shoe shiner illustrating a switch mechanism; an FIG. 8 shows a bottom view of the portable electric shoe shiner.
Figure 8:
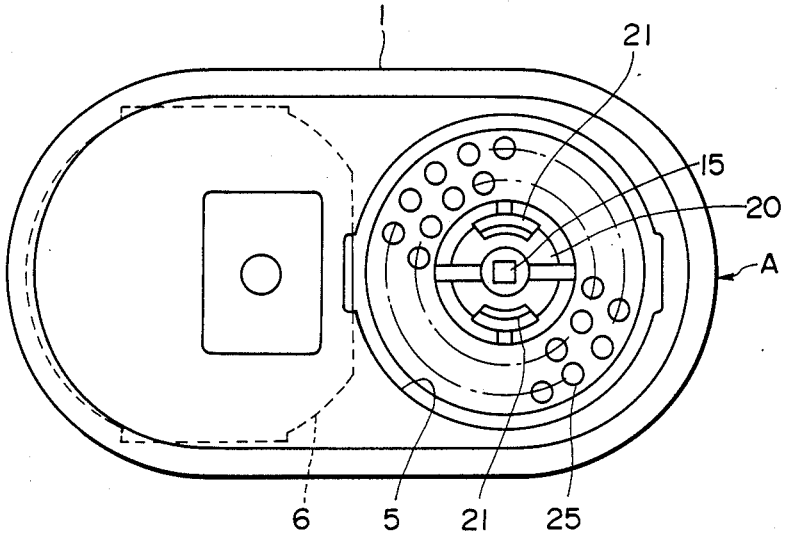

The present invention will be described in greater detail with reference to the accompanying drawings showing an embodiment of the present invention.

In the drawings, a mark A designates an portable electric shoe shiner. In the shoe shiner A, a battery housing 2 capable of holding a prescribed number of batteries 3 in an appropriate manner is formed in the rear portion of one end of a main case 1 made of synthetic resin. A substantially circular opening 5 is provided in the bottom of the other end of the main case 1. A sliding cover 6 for optionally opening or closing the opening 5 is slidably fitted in the sliding groove of the lower portion of the main case 1. A drive mechanism 10 constructed by assembling a motor 12, a speed reduction gear train 13 and a drive gear means 14 to a gear case 11 is provided in the main case 1. A rotary drive shaft 15 is slidably fitted in the shaft hole 14*b* of the drive gear means 14 so that the turning force of the drive gear means 14 is transmitted to the rotary drive shaft 15. A brush attaching device 20 is secured to the tip of the rotary drive shaft 15. A shoe brush 25 is removably mounted on the brush attaching device 20. Operating means 30 for the brush attaching device 20 is coupled thereto. A sliding switch 35 is connected to the operating means 30. The shoe brush 25 can be moved into or out of the opening 5 of the main case 1 by an of the sliding switch 35. The drive mechanism 10 acts in conjunction with the operation of the sliding switch 35 so as to rotate the shoe brush 25 when it has been moved out of the opening 5 of the main case 1.

Incidentally, in the drawings, reference numeral 4 designates a cover removably attached to the main case 1 and capable of opening and closing the battery housing 2.

In the drive mechanism 10, the drive gear means 14 is rotatably supported in the gear case 11 so that the drive gear means 14 is rotated in a prescribed direction by the motor 12 and the speed reduction gear train 13. The shaft hole 14*b* of quadrangular cross section is provided in the center of the cylindrical portion 14*a* of the drive gear means 14. The rotary drive shaft 15 of quadrangular cross section is slidably fitted in the shaft hole 14*b* so that the turning force of the drive gear means 14 is transmitted to the rotary drive shaft.

A plurality of resilient claws 21 project downward from the bottom of the brush attaching device 20 so that the shoe brush 25 is removably mounted on the brush attaching device 20 by the resilient claws 21. An engaging groove 22 for coupling the brush attaching device 20 to the operating means 30 is provided in the upper peripheral surface portion of the brush attaching device 20.

A mounting hole 26 is provided in the center of the shoe brush 25. The resilient claws 21 of the brush attaching device 20 are resiliently fitted in the mounting hole 26 of the shoe brush 25 so that the brush is removably mounted on the brush attaching device 20. As shown in the drawings, the shoe brush 25 may be made of a board having the mounting hole 26 and planted with shoe shining hair at the bottom surface of the board. However, the shoe brush 25 is not restricted to such constitution but may be made of a board fitted with shoe shining buff, for example.

The operating means 30 for the brush attaching device 20 is provided with an engaging portion 31 which is shaped substantially as U, located at the bottom of the operating means 30 and engaged with the engaging groove 22 of the brush attaching device 20 so as to sandwich it between both sides thereof. The operating means 30 is also provided with a guide shaft 32 held by the gear case 11 for supporting the operating means 30 so that the operating means 30 moves up and down correctly, and with a switch pusher 33 located at the upper portion of the operating means 30 and projecting sideward. The guide shaft 32 is slidably held by the gear case 11 in parallel with the rotary drive shaft 15 so that the operating means 30 can be smoothly moved up and down. In the drawings, reference numeral 34 designates an engaging projection extending sideward from the operating means 30 opposite the switch pusher 33 and removably engaged with the upper or lower engaging recess 11*b* of a resilient engaging member 11*a* provided in the main case 1. When the shoe brush 25 is moved out of the opening 5 of the main case 1, the engaging projection 34 is engaged with the lower engaging recess 11*b*. When the shoe brush 25 is moved into the opening 5 of the main case 1, the engaging projection 34 is engaged with the upper engaging recess 11*b*.

The sliding switch 35 is connected to the operating means 30 through the insertion hole 46 of a switch guide plate 45 constituting a part of the wall opposite the battery housing end of the main case 1 so that the operating means 30 is moved up and down as the sliding switch 35 is moved up and down. When the operating means 30 is moved down to a prescribed position as the sliding switch 35 is moved down (at that time, the shoe brush 25 is moved out of the opening 5 of the main case 1 and the engaging projection 34 is engaged with the lower engaging recess 11*b*), the switch pusher 33 of the operating means 30 pushes a switching member 36 disposed in parallel with another switching member 37 in the main case 1 so that the switching member 36 comes into contact with the other switching member 37. When the switching members 36 and 37 are in contact with each other, an electrical current flows from the batteries 3 in the battery housing 2 to the motor 12 of the drive mechanism 10 so that the motor is rotated.

In the drawings, a reference numeral 40 designates a locking switch 40, the butt portion 41 thereof being inserted in an insertion hole 35*a* provided substantially in the center of the sliding switch 35 and reference numeral 42 designates a resilient leg coupled to the butt portion 41 of the locking switch 40. The tip of the resilient le 42 is in resilient contact with the operating means 30 so as to apply a resilient force to the locking switch 40 in such a direction as to protrude the outer end of the butt portion 41 thereof outward from the insertion hole 35*a*. A reference numeral 43 designates an engaging projection 43 provided on both the sides of the butt portion 41 of the locking switch 40 so that the projections 43 are removably engaged with the upper and lower engaging recesses 47 of the back of the switch guide plate 45, respectively. In other words, when the sliding switch 35 is moved down to a prescribed position, the engaging projections 43 are engaged with the lower engaging recess 47 and, when the sliding switch 35 is moved up to a prescribed position, the engaging projections 43 are engaged with the upper engaging recesses 47. The engagement of the engaging projections 43 with the engaging recesses 47 is synchronized with that of the engaging projections 34 with the engaging recess 11*b*.

In the drawings, a reference numeral 50 designates a cover plate 50 covering the insertion hole 46 of the switch guide plate 45 and a reference numeral 51 designates an insertion hole for connecting the cover plate 50 to the operating means 30.

In the drawings, a reference numeral 60 designates an operating means for replacing the shoe brush 25 having legs 61 astride the gear case 11 at the lower portion thereof. The upper portion of the operating means 60 is exposed from the opening provided in the upper surface of the main case 1. When the upper portion of the operating means 60 is pushed down against the resilient force of a spring 62 provided between the operating means 60 and the gear case 11, the tips of the legs 61 of the operating means 60 forcibly press the top of the shoe brush 25 downward so that the resilient claws 21 are put out of the state of being fitted in the mounting hole 26 of the shoe brush 25. The shoe brush 25 can thus be demounted from the brush attaching device 20 in a one-shot manner.

In the above embodiment, the operating means 30 for the brush attaching device 20 is provided with an engaging projection 34, which is removably engaged with the upper or lower engaging recess 11*b* of a resilient engaging member 11*a* provided in the main case 1, and engaging projections 43, which are removably engaged with the upper and lower engaging recesses 47 of the back of a switch guide plate 45, are provided on both the sides of the butt portion 41 of the locking switch 40. As a result, the shoe brush 25 can be surely kept either moved to a prescribed position out of the main case 1 or moved to a prescribed position in the main case 1. The shoe brush 25 is thus prevented from being moved into the main case 1 due to the pressure of a shoe on the shoe brush 25 as the shoe brush 25 is being rotated to shine the shoe. Therefore, it is easy to handle the portable electric shoe shiner A.

And further, if only the operating means 60 for replacing the shoe brush 25 is pushed down against the resilient force of a spring 62, the legs 61 forcibly press the shoe brush 25 downward so that the shoe brush 25 fitted at the mounting hole thereof on the resilient claws 21 of the brush attaching device 20 is disengaged therewith. The shoe brush 25 can thus be demounted from the brush attaching device 20 in a one-shot manner.

In addition, since the cover plate 50 is provided to cover the insertion hole 46 of the switch guide plate 45, the appearance of the portable electric shoe shiner A is good.

The particular form, size and quality of the main case 1, the form, location and size of the opening 5, the particular constitution of the drive mechanism 10, the particular constitution, form and quality of the drive gear means 14, the particular constitution, form, size and quality of the brush attaching device 20, the particular constitution of the shoe brush 25, the means for mounting the shoe brush on the brush attaching device, the particular constitution of the operating means 30 for the brush attaching device 20, the means for engaging the operating means 30 with the brush attaching device 20, the form of the sliding switch 35, the particular constitution and form of the locking switch 40, the particular constitution and form of the switch guide plate 45, the particular constitution and form of the operating means 60 for replacing the shoe brush, and so forth are not restricted to the above embodiment but may be otherwise designed optionally and appropriately.

The operation of the portable electric shoe shiner of the embodiment mentioned above will be described in detail from now on. The sliding cover 6 is first slid so that the opening 5 is opened. The butt portion 41 of the locking switch 40 is pushed in against the resilient force of the resilient leg 42 so that the engaging projections 43 are disengaged from the upper engaging recess 47 of the switch guide plate 45. The sliding switch 35 is then forcibly moved down. As a result, the engaging projection 34 of the operating means 30 is disengaged with the upper recess 11*b* of the gear case 11 due to the resilience of the resilient member 11*a* so that the operating means 30 is moved down and the brush attaching device 20 and the shoe brush 25 are also moved down.

When the shoe brush 25 is moved down to a prescribed position out of the opening 5 of the main case 1, the switch pusher 33 of the operating means 30 for the brush attaching device 20 pushes the switching member 36 into contact with the other switching member 37 to close a circuit to rotate the motor 12. At that time, the engaging projection 34 of the operating means 30 is engaged with the lower engaging recess 11*b* of the gear case 11, and the engaging projections 43 of the locking switch 40 are engaged with the lower engaging recess 47 of the switch guide plate 45 due to the resilient force of the resilient leg 42 so that the shoe brush 25 is kept protruded down in the prescribed position.

As the motor 12 is rotated, the drive gear means 14 is turned through the speed reduction gear train 13 so that the rotary drive shaft 15, the brush attaching device 20 and the shoe brush 25 are rotated. As a result, a shoe can be shined by the portable electric shoe shiner.

After the shoe is shined, the locking switch 40 is pushed in to disengage the engaging projections 43 from the lower engaging recess 47, the sliding switch 35 is forcibly moved up to open the circuit and move the shoe brush 25 up into the main case 1, and the sliding cover 6 is slid to close the opening 5.

Incidentally, when the shoe brush 25 is moved up into the main case 1, the engaging projection 34 of the operating means 30 is engaged with the upper engaging recess 11*b* of the gear case 11 and the engaging projections 43 of the locking switch 40 are engaged with the upper engaging recesses 47 of the switch guide plate 45 due to the resilient force of the resilient leg 42, and the shoe brush is kept in the main case.

What is claimed is:

1. A portable shoe shiner comprising:

a shining member for shining shoes;

a driving means for rotating the shining member;

a housing for accommodating the shining member and the driving means therein; and a sliding means for slidably supporting the shining member between a projected position and a retracted position relative to the housing, the shining member projecting from the housing at the projected position and being retracted into the housing at the retracted position; and switch means for activating and deactivating said driving means so that movement of said shining member by said sliding means from said projected position to said retracted position causes said switch means to deactivate said driving means and so that movement of said shining member from said retracted position to said projected position causes said switch means to activate said driving means.

2. A portable shoe shiner according to claim 1, wherein the driving means comprises:

an electric motor for generating rotational force;

a transmission means for transmitting the rotational force to the shining member; and an attachment for detachably attaching the shining member to the transmission means.

3. A portable shoe shiner according to claim 1, wherein the shining member is a shoe brush.

4. A portable shoe shiner according to claim 1, wherein the shining member is a buff.

5. A portable shoe shiner according to claim 1, wherein the shining member is detachably attached to the driving means.

* * * * *